US007083461B2

(12) United States Patent
Ishiyama

(10) Patent No.: US 7,083,461 B2
(45) Date of Patent: Aug. 1, 2006

(54) CONNECTOR

(75) Inventor: Takayuki Ishiyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/010,714

(22) Filed: Dec. 13, 2004

(65) Prior Publication Data

US 2005/0130483 A1 Jun. 16, 2005

(30) Foreign Application Priority Data

Dec. 15, 2003 (JP) ..... 2003-416971

(51) Int. Cl.
*H01R 13/62* (2006.01)

(52) U.S. Cl. ..... 439/358

(58) Field of Classification Search ..... 439/358, 439/357, 350–356
See application file for complete search history.

(56) References Cited

U.S. PATENT DOCUMENTS 6,179,643 B1 * 1/2001 Fukuda ..... 439/358
6,217,365 B1 * 4/2001 Shinozaki ..... 439/358
6,325,656 B1 * 12/2001 Fukuda et al. ..... 439/358
6,416,345 B1 * 7/2002 Endo ..... 439/358
6,464,403 B1 * 10/2002 Koch et al. ..... 385/53
6,464,526 B1 * 10/2002 Seufert et al. ..... 439/352

FOREIGN PATENT DOCUMENTS

JP 2001-283979 10/2001

* cited by examiner

*Primary Examiner*—Gary F. Paumen
(74) *Attorney, Agent, or Firm*—Gerald E. Hespos; Anthony J. Casella

(57) ABSTRACT

Male and female housings (10, 20) are connected and locked together by the engagement of a lock arm (22) of the female housing (20) and a lock (18) of a receptacle (12). Upon separating the two housings (10, 20), an operable portion (24) at the rear end of the lock arm (22) is operated to disengage the lock arm (22) from the lock (18), thereby canceling the locked state. Since the operable portion (24) is located in a notch (17) formed at the front end edge of the receptacle (12) with the two housings (10, 20) connected, a connector can be miniaturized with respect to a connecting direction of the two housings (10, 20).

11 Claims, 11 Drawing Sheets

CONNECTOR

BACKGROUND OF THE INVENTION

1. Field of the Invention

The invention relates to a connector with a lock arm.

2. Description of the Related Art

Japanese Unexamined Patent Publication No. 2001-283979 discloses a connector that has male and female housings. The male housing has a receptacle with an open front end and the female housing fits in the receptacle to connect the housings. The female housing has a lock arm and the receptacle has a lock that is engageable with the lock arm. The lock arm engages the lock to hold the housings together. An operable portion is formed at the rear end of the lock arm and can be actuated to deform the lock arm. Thus, the lock arm disengages from the lock to cancel the locked state.

The operable portion is exposed to the outside of the receptacle so that the operable portion can be pressed. However, the exposure of the operable portion to the outside of the receptacle means that the entire length of the connector is longer when the housings are connected with each other.

The invention was developed in view of the above problem and an object thereof is to miniaturize a connector in a state where two housings are connected with each other.

SUMMARY OF THE INVENTION

The invention relates to a connector with first and second housings. The first housing has a receptacle with an open front end. The second housing can fit in the receptacle for connection with the first housing. A lock arm is cantilevered to extend back from the second housing, and the receptacle has a lock that is engageable with the lock arm. The lock arm engages the lock to lock the housings together. An operable portion is formed at the rear end of the lock arm and can be operated to disengage the lock arm from the lock for canceling a locked state. A notch is formed at the front of the receptacle. The operable portion is in the notch and exposed to the outside of the receptacle when the housings are connected together. Thus, the connector can be miniaturized with respect to a connecting direction of the housings. Further, the operable portion is exposed to the outside of the receptacle, and there is no likelihood that the operable portion will hinder an unlocking operation.

The rearmost end of the second housing preferably is at substantially the same position as the front end of the receptacle or inside the receptacle when the housings are connected together. Thus, interference of external matter with the second housing can be prevented.

A finger-placing portion preferably is near the operable portion at the rear end of the second housing and preferably is in the notch when the housings connected with each other. Fingers can be placed on the finger-placing portion for unlocking the lock arm and pulling the second housing from the first housing. Two finger-placing portions preferably are at substantially opposite sides of the operable portion of the lock arm.

The finger-placing portion preferably has a standing portion and a finger touching portion. The finger-placing portion projects from the second housing and the finger touching portion extends towards the operable portion from the outer end of the standing portion. The finger-placing portion preferably projects more outward than the outer surface of the receptacle.

An outer portion of the operable portion preferably projects more outward than the outer surface of the receptacle.

A guiding recess preferably is formed at the rear edge of the notch and/or of the receptacle. Further, the lock arm preferably has a guiding surface for guiding the resilient deformation thereof.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
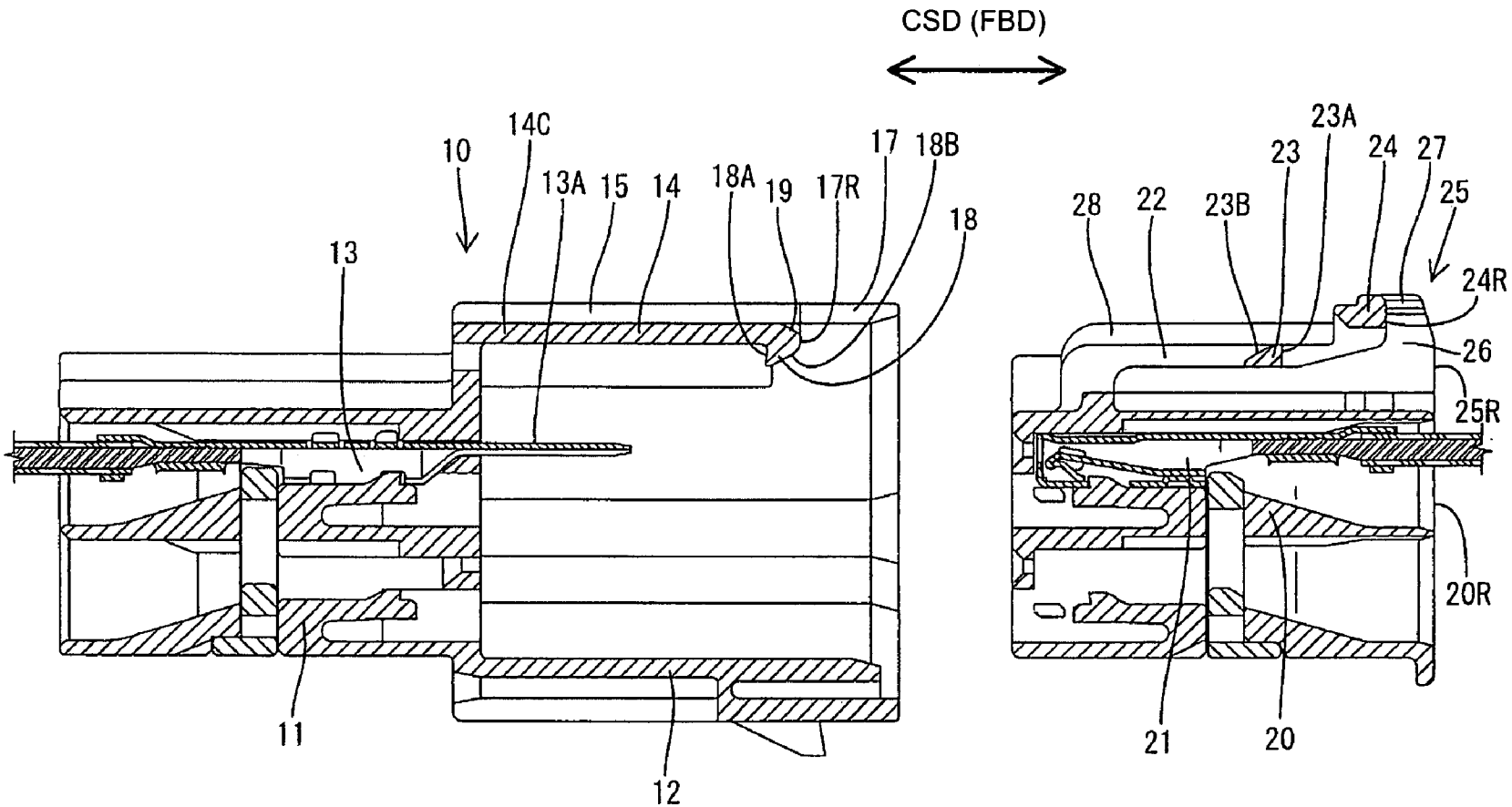
FIG. 1 is a section showing a state where a male housing and a female housing are separated.
Figure 2:
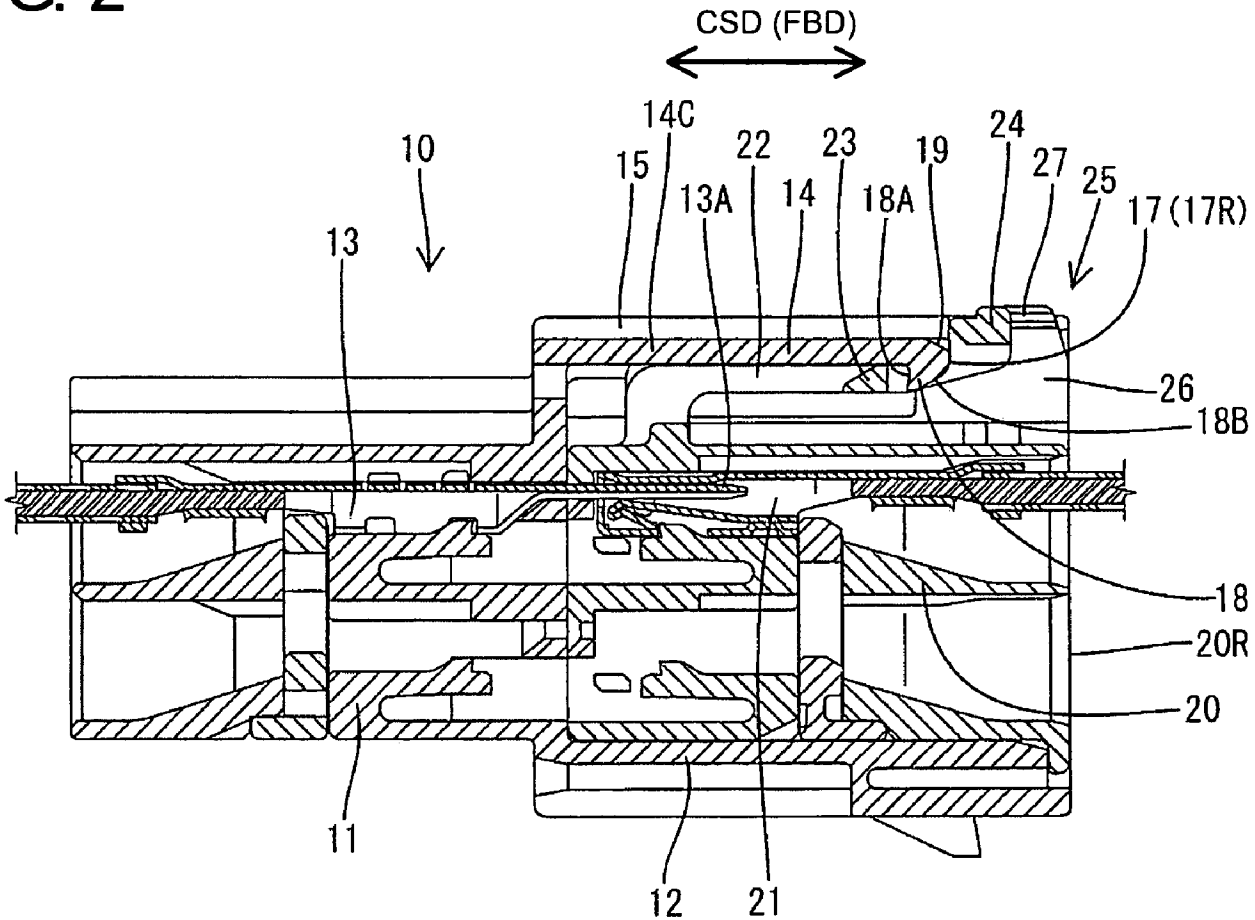
FIG. 2 is a section showing the two housings are connected.
Figure 3:
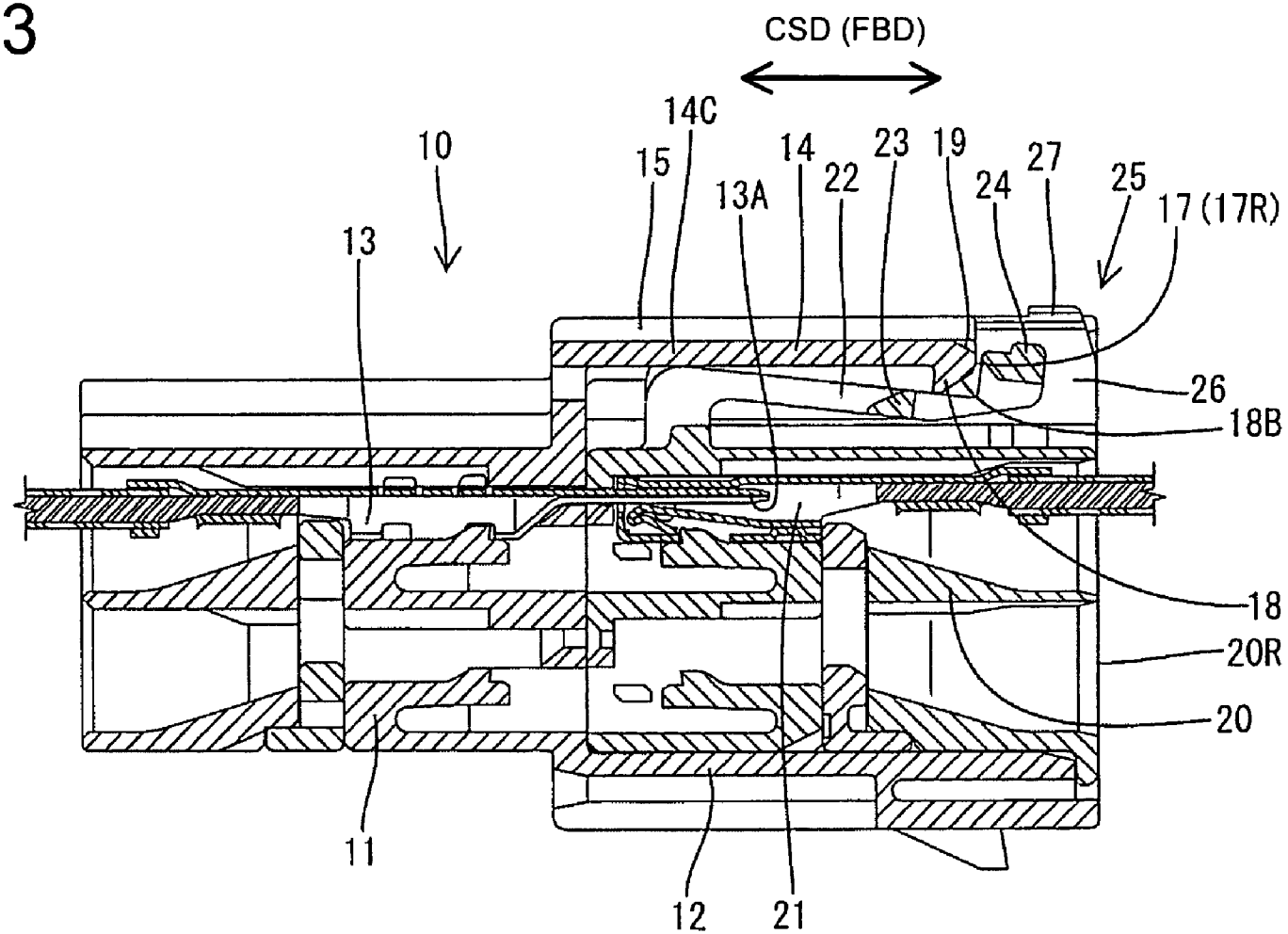
FIG. 3 is a section showing a state where locking by a lock arm is canceled.
Figure 4:
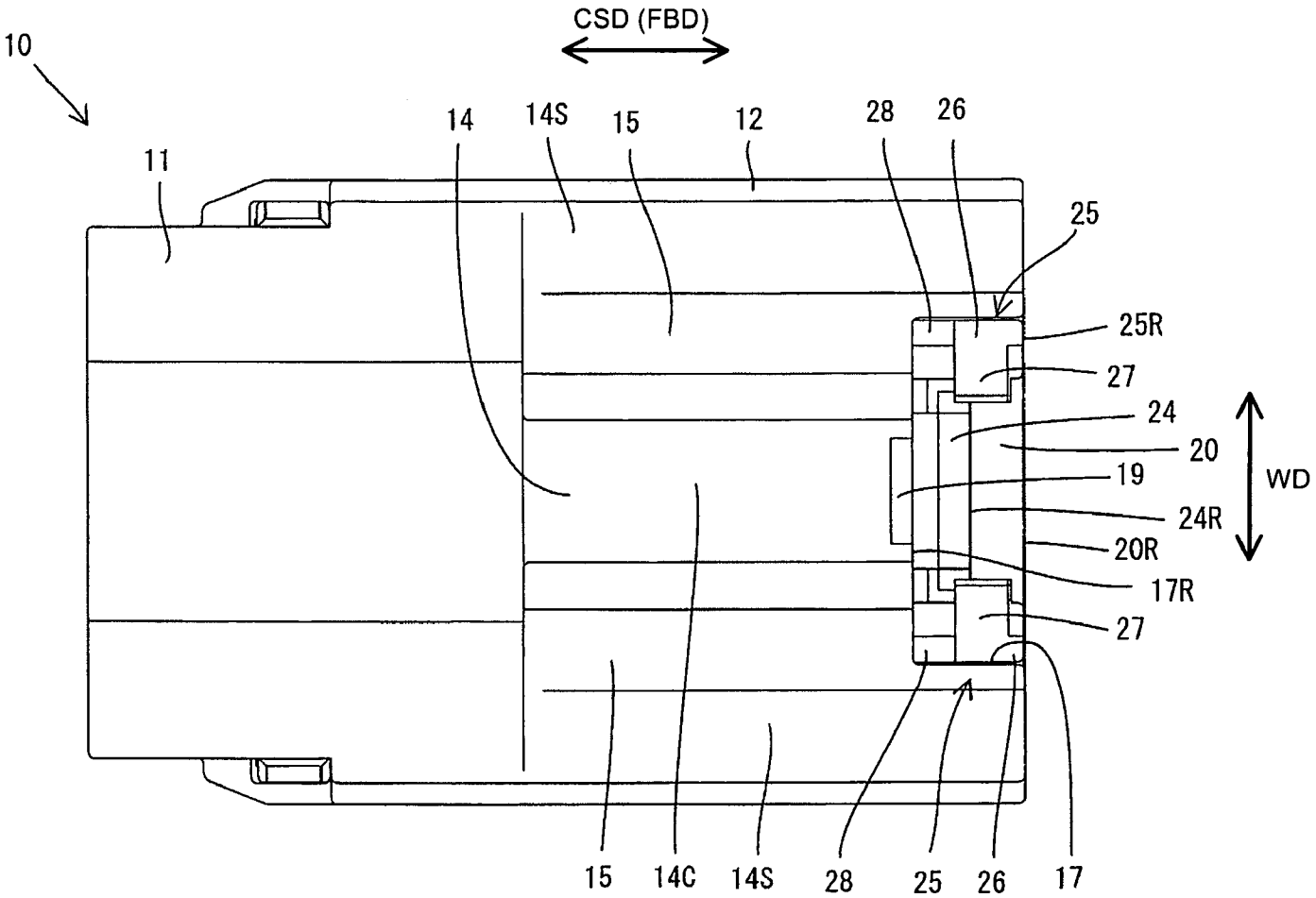
FIG. 4 is a plan view showing the housings connected.
Figure 5:
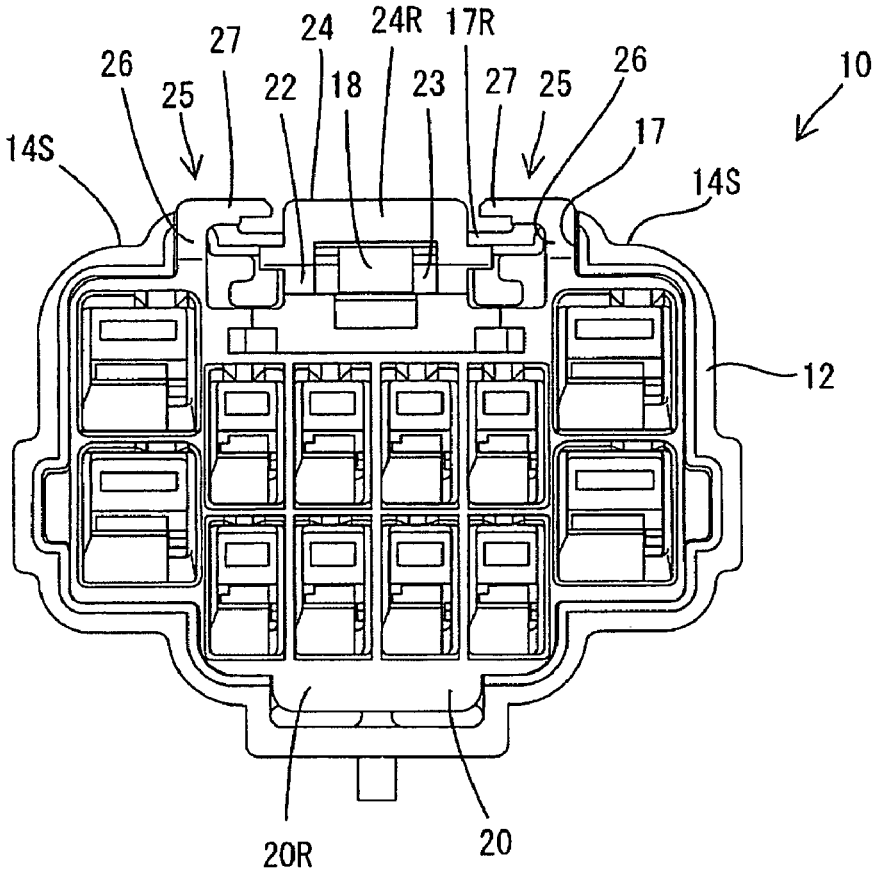
FIG. 5 is a front view of the male housing connected with the female housing.
Figure 6:
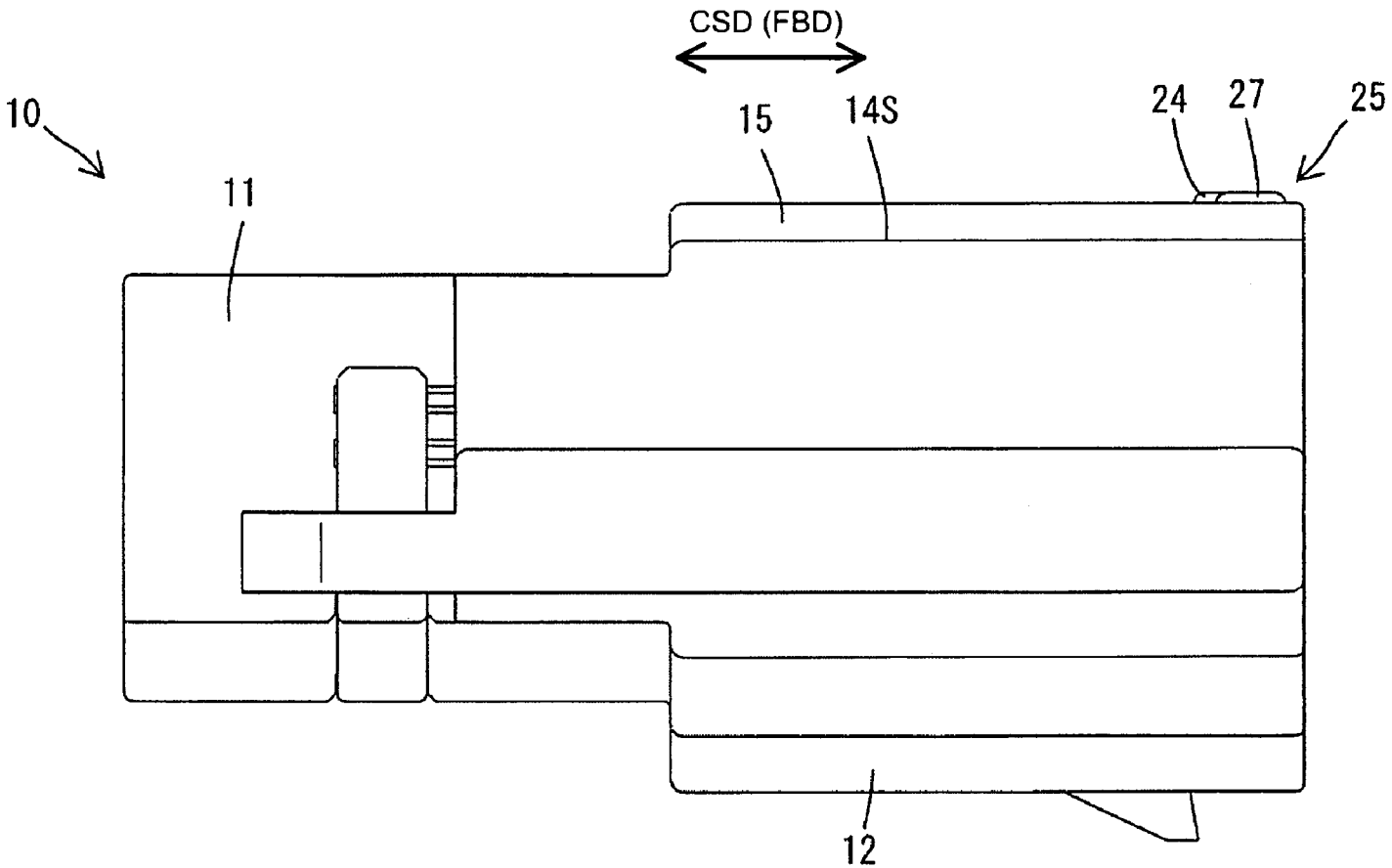
FIG. 6 is a side view showing the two housings connected.
Figure 7:
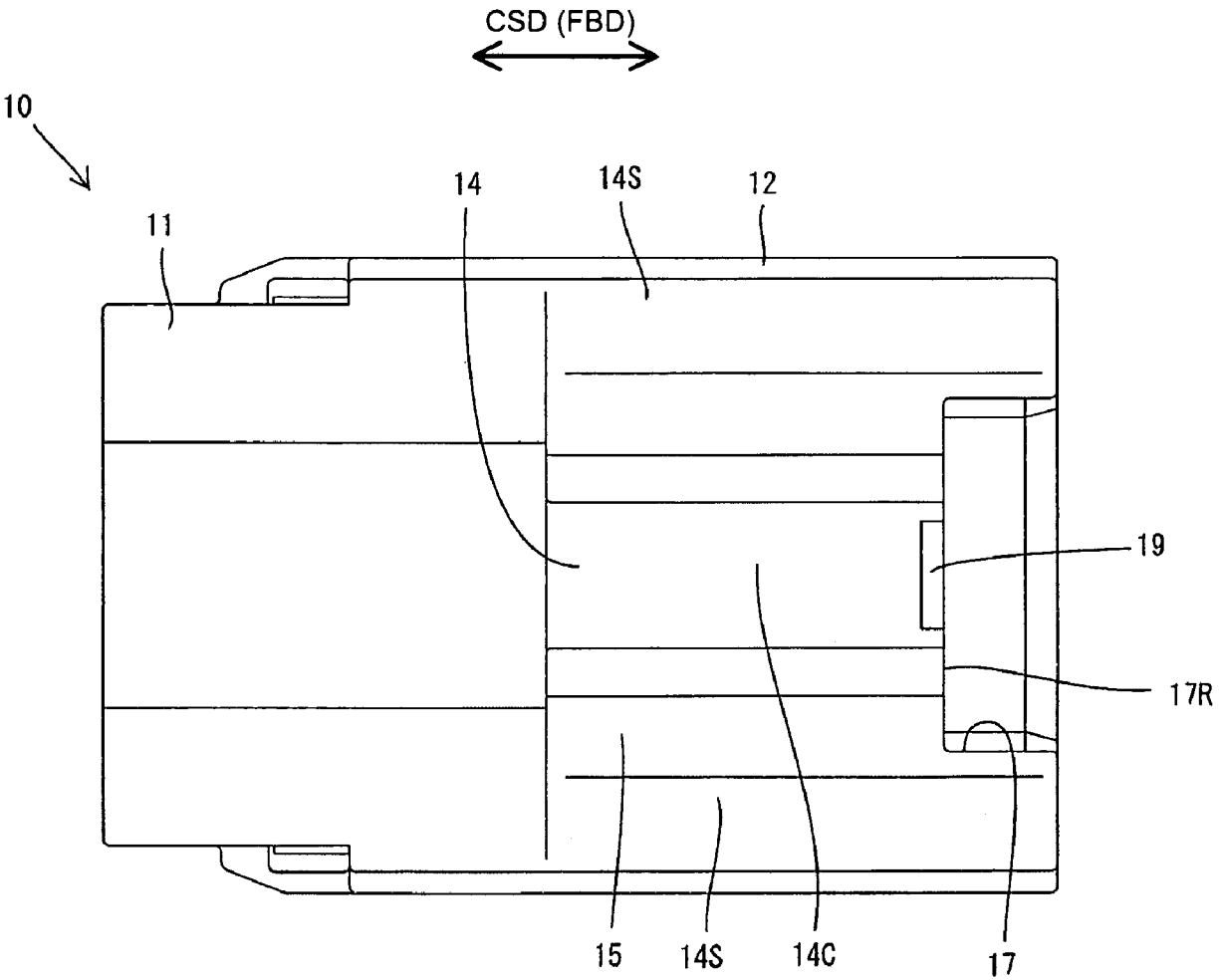
FIG. 7 is a plan view of the male housing.
Figure 8:
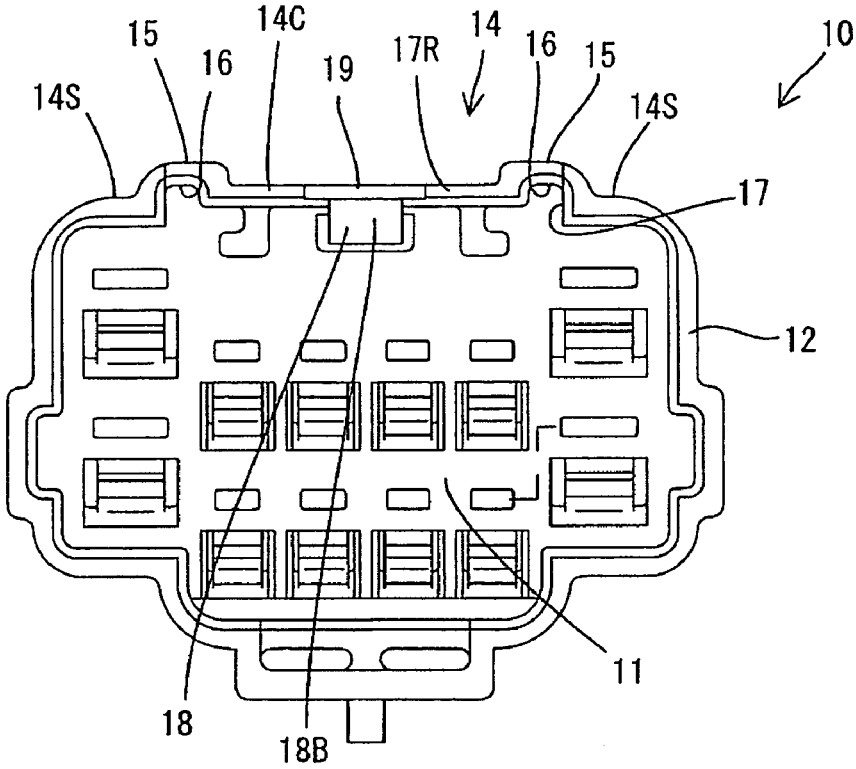
FIG. 8 is a front view of the male housing.
Figure 9:
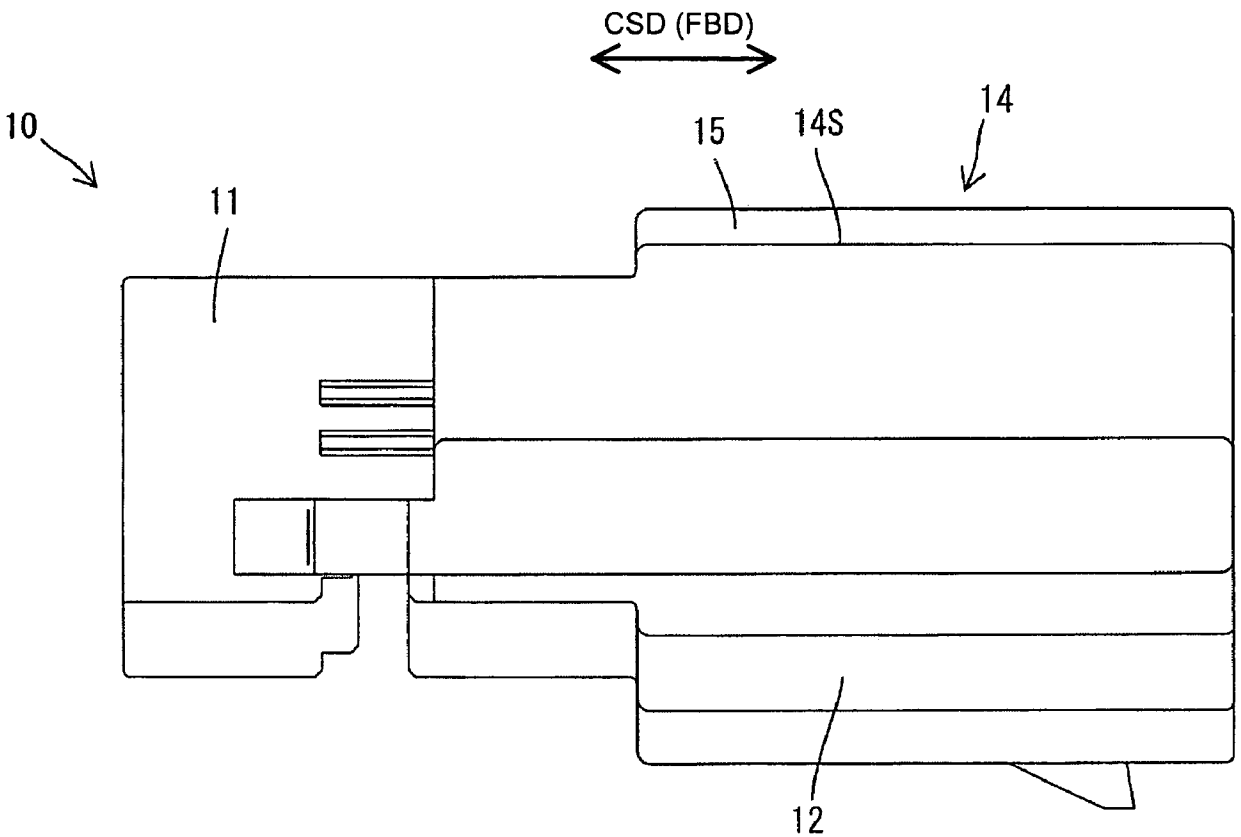
FIG. 9 is a side view of the male housing.
Figure 10:
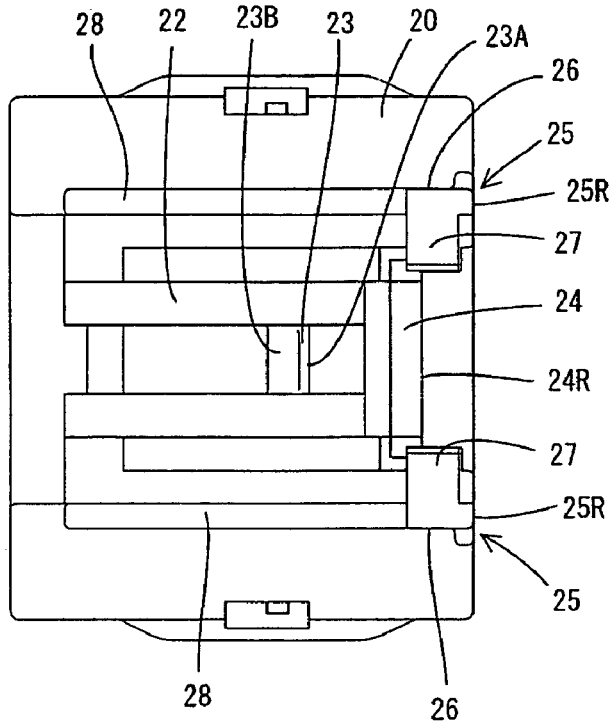
FIG. 10 is a plan view of the female housing.
Figure 11:
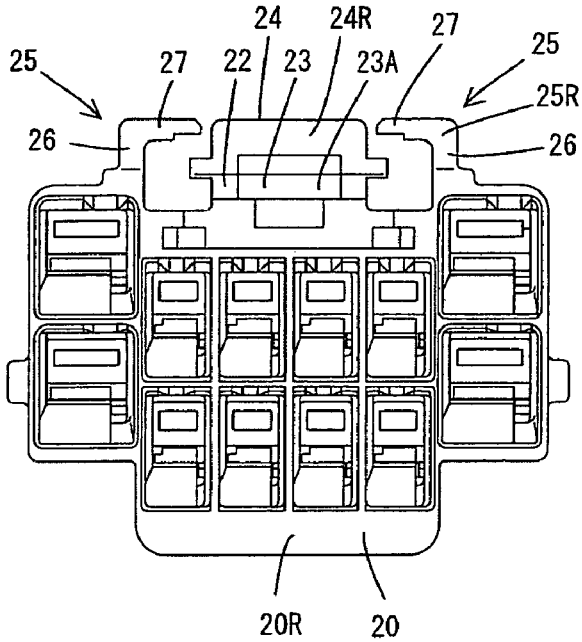
FIG. 11 is a front view of the female housing.
Figure 12:
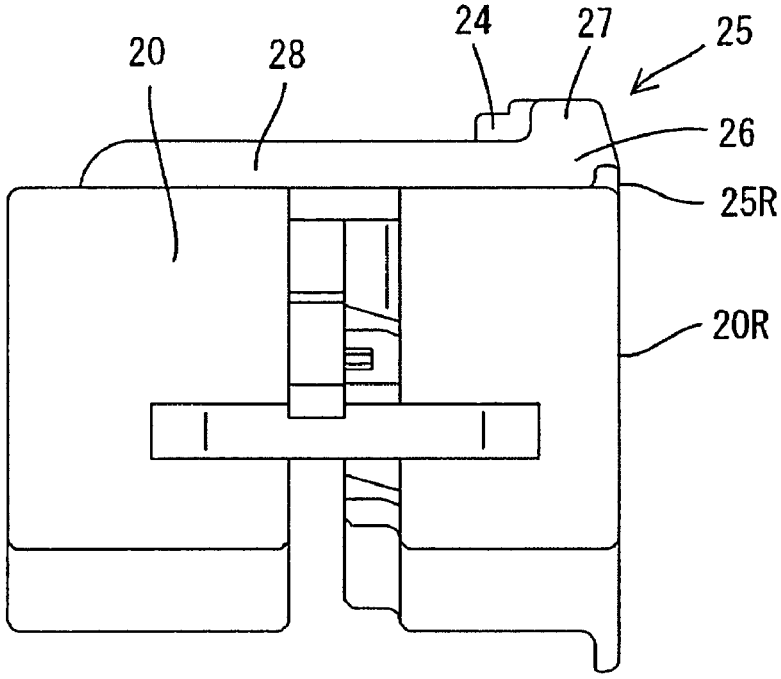
FIG. 12 is a side view of the female housing.

A connector according to the invention is described with reference to FIGS. 1 to 12. The connector has a male housing 10 and a female housing 20 that can be connected to abut the front surfaces thereof against each other. The housings 10, 20 also can be separated from a connected state thereof. The terms upper and lower are used herein to provide a convenient frame of reference, but are not intended to imply a required gravitational orientation.

The male housing 10 is made e.g. of a synthetic resin, and has a main body 11. A substantially rectangular transversely symmetrical receptacle 12 extends forward from the front end of the main body 11. Male terminal fittings 13 are accommodated in the main body 11, and tabs 13A at the front ends of the male terminal fittings 13 project into the receptacle 12. The receptacle 12 has an open front end and upper wall 14. Left and right narrow bulges 15 bulge out upward from the upper wall 14 and extend substantially straight along forward and backward directions FBD, which is parallel with connecting and separating directions CSD of the two housings 10, 20. The bulges 15 define escaping grooves 16 in the inner peripheral surface of the receptacle 12. Thus, the upper wall 14 of the receptacle 12 has a stepped configuration so that the bulges 15 are elevated relative to a widthwise middle area 14C and left and right end areas 14S.

The opening edge of the receptacle 12 at the front end of the upper wall 14 is recessed to form a notch 17 that vertically penetrates the upper wall 14. The notch 17 extends in a widthwise direction WD within a range from the left inner surface of the left escaping groove 16 to the opposite right inner surface of the right escaping groove 16. Thus, the notch 17 extends across the left and right escaping grooves 16 and the middle area 14C. The notch 17 is substantially rectangular in plan view, and a dimension of the notch 17 along forward and backward directions FBD is smaller than the width of the notch 17 along the widthwise direction WD.

A lock 18 is formed on the inner surface of the upper wall 14 and projects down into the receptacle 12 along a rear end edge 17R of the notch 17. The lock 18 is narrower than the notch 17. A locking surface 18A faces rearwardly on the lock 18 and is aligned substantially normal to the connecting direction CSD of the two housings 10, 20. The lock 18 also has a slanted or rounded guiding surface 18B that slopes up and out towards the front and oblique to the connecting direction CSD of the two housings 10, 20.

A slanted or rounded guiding recess 19 is formed in the outer surface of the upper wall 14 and slopes down and in towards the front until substantially reaching the rear end edge 17R of the notch 17. The guiding recess 19 is slightly wider than the lock 18.

The female housing 20 is made e.g. of a synthetic resin, and has a substantially block-shape for fitting into the receptacle 12 from the front. Female terminal fittings 21 are accommodated in the female housing 20.

A lock arm 22 is formed unitarily on the upper surface of the female housing 20 and cantilevers rearwardly. The lock arm 22 has an engaging portion 23 slightly more backward than a middle position along the forward and backward directions FBD. A locking surface 23A faces rearwardly on the engaging portion 23 and is aligned substantially normal to the connecting direction CSD of the two housings 10, 20. A slanted or rounded guiding surface 23B slopes down and in towards the front from the upper surface of the engaging portion 23. The height of the lock arm 22 from the outer surface of the female housing 20 is slightly lower than the lower surface of the widthwise middle area 14C of the upper wall 14 of the receptacle 12 when the housings 10, 20 connected with each other.

An operable portion 24 projects up at the rear end of the lock arm 22 and a rear surface 24R of the operable portion 24 is before a rear end surface 20R of the female housing 20. The upper surface of the operable portion 24 has a stepped configuration so that a front portion is lower than a rear portion. The upper surface of the front area is at substantially the same height as the upper surfaces of the bulges 15 on the upper wall 14 of the receptacle 12 when the housings 10, 20 are connected. The front surface of the operable portion 24 is positioned to contact the rear end edge 17R of the notch 17 when the two housings 10, 20 are connected.

Left and right finger-placing portions 25 are formed at the rear end of the upper surface of the female housing 20. The finger-placing portions 25 are at opposite sides of the operable portion 24 of the lock arm 22. When viewed longitudinally from behind, each finger-placing portion 25 has a standing portion 26 that projects up from the upper surface of the female housing 20, and a finger touching portion 27 in the form of a substantially horizontal plate that extends in toward the operable portion 24 from the upper end of the standing portion 26. Thus, each finger-placing portion 25 is substantially L-shaped. A clearance is defined along the width direction WD between the extending inner end of each finger touching portion 27 and the operable portion 24. The front surfaces of the finger-placing portions 25 are behind the front surface of the operable portion 24 and, accordingly, the front end edges thereof are spaced from the rear end edge 17R of the notch 17 when the housings 10, 20 are connected. Rear end surfaces 25R of the finger-placing portions 25 are behind the rear end surface 24R of the operable portion 24 and are substantially flush with the rear end surface 20R of the female housing 20. The upper surfaces of the finger-placing portions 25 are at substantially the same height as the upper surface of the rear area of the operable portion 24 in a free state where the lock arm 22 is not resiliently deformed. A distance between the left outer surface of the left standing portion 26 and the opposite right outer surface of the opposite right standing portion 26 is equal to or slightly less than the opening width of the notch 17.

Left and right ribs 28 are formed on the upper surface of the female housing 20 and extend forward from the front edges of the standing portions 26 of the finger-placing portions 25. The height of the ribs 28 from the upper surface of the female housing 20 is lower than that of the finger touching portions 27, but higher than the upper surface of the lock arm 22. The ribs 28 fit in the escaping grooves 16 of the receptacle 12 when the two housings 10, 20 are connected with each other.

The two housings 10, 20 are connected along the connecting and separating directions CSD so that the female housing 20 is pushed into the receptacle 12. As a result, the slanted guiding surface 23B of the engaging portion 23 of the lock arm 22 contacts the slanted guiding surface 18B of the lock 18 of the receptacle 12. The engaging portion 23 moves under the lock 18 and the lock arm 22 is deformed resiliently down and in due to the inclination of the two slanted guiding surfaces 18B, 23B. The engaging portion 23 completely passes the lock 18 when the housings 10, 20 are connected to a proper position. The lock arm 22 then is restored resiliently up and out. Accordingly, the locking surface 23A of the engaging portion 23 and the locking surface 18A of the lock 18 substantially oppose each other along forward and backward directions FBD with a small clearance therebetween. As a result, the housings 10, 20 are locked together so as not to separate (see FIG. 2).

In this connected state, the operable portion 24 of the lock arm 22 is accommodated entirely in the opening area of the notch 17 with respect to forward and backward directions FBD. A substantially upper half of the operable portion 24 projects up beyond the upper surface of the widthwise middle area 14C of the upper wall 14 of the receptacle 12, and fingers of an operator can contact the front end edge of this projecting part of the operable portion 24. The finger-placing portions 25 also are accommodated entirely in the open area of the notch 17 with respect to forward and backward directions FBD. The finger touching portions 27 of the finger-placing portions 25 also project up and out beyond the upper surface of the widthwise middle area 14C of the upper wall 14. As a result, fingers of the operator can contact the front edges of the projecting parts of the finger touching portions 27. The substantially flat rear end surface 20R of the female housing 20 is substantially flush with a front surface 12F of the receptacle 12 with respect to forward and backward directions FBD. In other words, the entirety of the female housing 20 including the lock arm 22 and the finger placing portions 25 is accommodated in the receptacle 12 with respect to forward and backward directions FBD.

The housings 10, 20 may have to be separated from each other. Thus, fingers can be placed on the operable portion 24 from above to push the operable portion 24 down. The lock arm 22 deforms resiliently down and in to disengage the engaging portion 23 from the lock 18, thereby canceling the locked state (see FIG. 3). At this time, fingers or a jig can catch the front edges of the finger touching portions 27 at opposite sides of the operable portion 24. Accordingly, the female housing 20 may be pulled out of the receptacle 12 e.g. with the fingers caught by the front end edge of the operable portion 24 and the front end edges of the finger toughing portions 27.

Some fingers or the like may contact the upper surface of the receptacle 12 to press the operable portion 24 down and in. However, these fingers will slide towards the operable portion 24 due to the inclination of the guiding recess 19 and will leave the receptacle 12 since the slanted guiding recess 19 is formed in this contact area. Thus, the fingers do not hinder the operation of pressing the operable portion 24 down.

As described above, the notch 17 is formed by cutting or recessing the front end edge of the receptacle 12 and the operable portion 24 of the lock arm 22 is at least partly in the notch 17 when the housings 10, 20 are connected. Therefore, the connector can be miniaturized along the connecting direction CSD of the housings 10, 20.

The operable portion 24 located in the notch 17 is exposed to the outside of the receptacle 12. Thus, there is no likelihood of hindering the unlocking operation by the operable portion 24.

The rear end surface 20R of the female housing 20 is at substantially the same position as the front end 12F of the receptacle 12 with respect to forward and backward directions FBD when the housings 10, 20 are connected. Thus, an interference of external matter from outside with a part of the female housing 20 projecting forward from the front end of the receptacle 12 can be prevented.

Further, the finger placing portions 25 are formed near the operable portion 24 at the rear end of the female housing 20, and are located in the notch 17 when the housings 10, 20 are connected. Thus, upon separating the two housings 10, 20, the female housing 20 can be pulled easily out of the receptacle 12 by directly catching the finger placing portions 25 e.g. by the fingers or the like placed on the operable portion 24 for unlocking.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The operable portion at the rear end of the lock arm is before the rear end surface of the female housing in the foregoing embodiment. However, the invention is also applicable to connectors where the rear end surface of an operable portion is at the same position as or behind the rear end surface of a female housing.

The rearmost end of the female housing is at the same position as the front end of the receptacle with respect to forward and backward directions FBD in the foregoing embodiment. However, the rear end of the female housing may project forward from the receptacle.

The female housing has one or more finger placing portions in the foregoing embodiment. However, the present invention is also applicable to connectors with no finger-placing portion.

The operable portion projects out beyond the outer surface of the receptacle in the foregoing embodiment. However, the outer surface of the operable portion may be substantially flush with or more inward than the outer surface of the receptacle according to the present invention.

The finger placing portions project more outward than the outer surface of the receptacle in the foregoing embodiment. However, the outer surfaces of the finger placing portions may be substantially flush with or more inward than the outer surface of the receptacle according to the invention.

Although the slanted guiding recess is formed at the rear edge portion of the notch in the foregoing embodiment, no such guiding recess may be formed according to the present invention.

The upper wall of the receptacle with the notch has a stepped cross section in the foregoing embodiment. However, the upper wall with the notch may be flat and may have no elevation.

The widthwise middle area of the upper wall of the receptacle where the notch is formed is lowered in the foregoing embodiment. However, it may be raised according to the invention.

The front end edge of the operable portion contacts the rear end edge of the notch when the two housings are connected with each other in the foregoing embodiment. However, the front edge may be distanced from the rear end edge of the notch according to the present invention.

The front end edges of the finger placing portions are distanced from the rear end edge of the notch when the housings are connected with each other in the foregoing embodiment. However, they may contact the rear end edge of the notch according to the present invention.

The lock of the receptacle is a projection in the foregoing embodiment. However, the lock may be a recess or a through hole.

What is claimed is:

1. A connector, comprising:

a first housing with a receptacle having an open front end, a lock formed in the receptacle; and a second housing fittable into the receptacle for connection with the first housing, a lock arm cantilevered rearwardly on the second housing and being engageable with the lock in the receptacle to lock the housings together, an operable portion being formed on a rear end of the lock arm and being operable to cancel a locked state of the housings so that the housings can be separated, wherein:

a notch is formed at a front edge of the receptacle, the operable portion is at least partly in the notch and exposed outside of the receptacle when the housings are connected, and two finger placing portions disposed respectively at opposite sides of the operable portion and substantially adjacent a rear end of the second housing, the finger placing portions being completely in the notch when the housings are connected, each of said finger placing portions including a standing wall projecting from the second housing and a finger touching plate extending towards the operable portion from an outer end of the standing wall.

2. The connector of claim 1, wherein a rear end of the second housing is flush with or internally of a front end of the receptacle when the housings are connected.

3. The connector of claim 1, wherein the finger placing portions project out beyond an outer surface of the receptacle.

4. The connector of claim 1, wherein an outer surface of the operable portion projects more outward than an outer surface of the receptacle.

5. The connector of claim 1, wherein a guiding recess is formed at a rear edge of the notch.

6. The connector of claim 1, wherein the lock arm comprises a guiding surface for guiding a resilient deformation of the lock arm.

7. A connector, comprising:

a first housing with opposite front and rear ends, a forwardly-open receptacle extending into the front end, a notch extending rearwardly into the open front end of the housing, and a lock projecting into the receptacle from a location on the housing adjacent to and rearward of the notch; and a second housing having opposite front and rear ends and being fittable into the receptacle for connection with the first housing, the second housing being dimensioned so that the rear end of the second housing is flush with or forward of the front end of the first housing when the housings are connected, a resiliently deflectable lock arm cantilevered rearwardly on the second housing and having an engaging portion engageable with the lock in the receptacle to lock the housings together, an operable portion in proximity to a rear end of the lock arm and being operable to deflect the lock arm for canceling a locked state of the housings and at least one finger placing portion projecting substantially rigidly from the second housing substantially adjacent the lock arm, the operable portion and the finger placing portion being in the notch when the housings are connected, whereby the finger placing portion is engageable when the lock arm is deflected so that the housings can be separated.

8. The connector of claim 7, wherein two finger placing portions are located at substantially opposite sides of the operable portion of the lock arm.

9. The connector of claim 8, wherein the finger placing portions project out beyond an outer surface of the receptacle.

10. The connector of claim 7, wherein an outer surface of the operable portion projects more outward than an outer surface of the receptacle.

11. The connector of claim 7, wherein the second housing further comprises first and second standing walls substantially adjacent the rear end of the second housing and projecting from opposite respective sides of the lock arm and first and second finger touching plates extending towards one another and partly over the lock arm from projecting ends of the first and second standing walls respectively, the operable portion of the lock arm being between the finger touching plates.

* * * * *